US010140905B2

(12) United States Patent
Choi et al.

(10) Patent No.: US 10,140,905 B2
(45) Date of Patent: Nov. 27, 2018

(54) CONTROLLER, DATA DRIVER CIRCUIT, DISPLAY DEVICE, AND METHOD OF DRIVING THE SAME

(71) Applicant: LG DISPLAY CO., LTD., Seoul (KR)

(72) Inventors: SungHoon Choi, Goyang-si (KR); Hanjin Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 32 days.

(21) Appl. No.: 15/295,765

(22) Filed: Oct. 17, 2016

(65) Prior Publication Data

US 2017/0116898 A1 Apr. 27, 2017

(30) Foreign Application Priority Data

Oct. 22, 2015 (KR) ..... 10-2015-0147504

(51) Int. Cl.

*G09G 3/3291* (2016.01)
*G09G 3/20* (2006.01)
*G09G 3/36* (2006.01)

(52) U.S. Cl.

CPC ..... *G09G 3/2003* (2013.01); *G09G 3/3291* (2013.01); *G09G 3/3688* (2013.01); *G09G 2300/0452* (2013.01); *G09G 2310/027* (2013.01); *G09G 2310/08* (2013.01); *G09G 2320/0666* (2013.01)

(58) Field of Classification Search

CPC ... G09G 3/2003; G09G 3/3291; G09G 3/3268
See application file for complete search history.

(56) References Cited

U.S. PATENT DOCUMENTS

2003/0080931 A1* 5/2003 Chen ..... G09G 3/2011 345/88
2008/0055137 A1* 3/2008 Yen ..... H03M 1/667 341/144
2014/0104262 A1* 4/2014 Miyake ..... G09G 3/3696 345/212
2016/0379576 A1* 12/2016 Shin ..... G09G 3/3607 345/694
2017/0010712 A1* 1/2017 Yoshizumi ..... G06F 3/044

* cited by examiner

*Primary Examiner* — Towfiq Elahi
(74) *Attorney, Agent, or Firm* — Seed Intellectual Property Law Group LLP

(57) ABSTRACT

A controller, a data driver circuit, a display device, and a method of driving the same are provided. Color-specific data driving is performed through adaptive overdriving in consideration of differences in response times of color-specific subpixels. Differences in response times of color-specific subpixels due to different thicknesses of color-specific pigment layers are reduced.

14 Claims, 15 Drawing Sheets

CONTROLLER, DATA DRIVER CIRCUIT, DISPLAY DEVICE, AND METHOD OF DRIVING THE SAME

CROSS REFERENCE TO RELATED APPLICATION

This application claims priority from Korean Patent Application Number 10-2015-0147504 filed on Oct. 22, 2015, which is hereby incorporated by reference for all purposes as if fully set forth herein.

BACKGROUND

Technical Field

The present disclosure relates to a controller, a data driver circuit, a display device, and a method of driving the same.

Description of Related Art

In response to the development of the information society, there has been increasing demand for various types of display devices able to display images. Recently, a range of display devices, such as liquid crystal display (LCD) devices, plasma display panels (PDPs), and organic light-emitting diode (OLED) display devices, have come into use.

In such display devices, color-specific pigment layers are provided in the areas of subpixels to realize color filters or the like.

The thickness of each color-specific pigment layer may be designed to improve color filtering performance for the target color.

Since color-specific pigment layers may have different thicknesses to improve color filtering performance as described above, color-specific subpixels may be observed as having different response times, thereby lowering image quality.

BRIEF SUMMARY

Various aspects of the present disclosure provide a controller, a data driver circuit, a display device, and a method of driving the same, in which color-specific data driving can be performed in color-specific subpixels by differentiating overdriving, whereby response times of the color-specific subpixels are improved to be faster.

Also provided are a controller, a data driver circuit, a display device, and a method of driving the same, in which data driving can be performed by differentiating overdriving, in consideration of the thicknesses of pigment layers of color-specific subpixels, whereby response times of the color-specific subpixels are improved to be faster.

Also provided are a controller, a data driver circuit, a display device, and a method of driving the same, in which differences in response times of color-specific subpixels due to different thicknesses of color-specific pigment layers can be reduced.

According to an aspect of the present disclosure, a display device may include: a display panel on which m number of data lines, where m is a natural number equal to or greater than 2, and n number of gate lines, where n is a natural number equal to or greater than 2, are disposed and subpixels corresponding to c number of colors, where c is a natural number equal to or greater than 2, are formed; a data driver circuit supplying data voltages to the subpixels through the m number of data lines; and a controller providing image data to the data driver circuit and controlling the data driver circuit In the display device, the data driver circuit may supply data voltages overdriven by overdriving voltages to subpixels corresponding to one to c−1 number of colors among the subpixels corresponding to c number of colors.

Alternatively, the data driver circuit may supply overdriven data voltages to the subpixels corresponding to c number of colors, subpixels corresponding to at least one color among the subpixels corresponding to c number of colors being supplied with data voltages overdriven by a different overdriving voltage.

According to another aspect of the present disclosure, a display device may include: a display panel on which m number of data lines, where m is a natural number equal to or greater than 2, and n number of gate lines, where n is a natural number equal to or greater than 2, are disposed and a plurality of subpixels are formed; a data driver circuit supplying data voltages to the plurality of subpixels through the m number of data lines; and a controller providing image data to the data driver circuit and controlling the data driver circuit The data driver circuit may supply data voltages overdriven differently according to thicknesses of pigment layers in the plurality of subpixels to the plurality of subpixels.

According to another aspect of the present disclosure, a controller may include: a color information storage device containing information about colors of a plurality of subpixels disposed on a display panel; and an overdriving controller converting image data for the plurality of subpixels into overdriven image data by referring to the information about the colors of the plurality of subpixels and outputting the overdriven image data.

In the controller, the overdriving controller may convert the image data regarding the plurality of subpixels into the overdriving image data, by referring to the information about the colors of the plurality of subpixels and further based on predetermined color-specific overdriving levels.

Color-specific overdriving levels may be referred to when the image data are converted into the overdriven image data.

An overdriving level for a specific color among the color-specific overdriving levels may be 0.

In addition, an overdriving level for at least one color among the referred color-specific overdriving levels may be different from overdriving levels for the other colors.

According to another aspect of the present disclosure, a method of driving a display device may include: receiving image data for a plurality of subpixels disposed on a display panel; converting the image data for the plurality of subpixels into overdriven image data, based on information about colors of the plurality of subpixels and color-specific overdriving levels; and outputting the overdriven image data.

According to another aspect of the present disclosure, a data driver circuit may include: an image data input section configured to receive image data; a digital-to-analog converter configured to convert the image data into data voltages corresponding to analog voltages; and an output buffer configured to output the data voltages to data lines.

The data voltages overdriven by overdriving voltages may be output to data lines connected to subpixels corresponding to one to c−1 number of colors among subpixels corresponding to c number of colors, the subpixels being disposed on a display panel, where c is a natural number equal to or greater than 2.

Overdriven data voltages may be output to data lines connected to the subpixels corresponding to c number of colors, data voltages overdriven by a different overdriving voltage being output to data lines connected to subpixels corresponding to at least one color among the subpixels corresponding to c number of colors.

In one or more embodiments of the present disclosure, the controller, the data driver circuit, the display device, and the method of driving the same are able to perform color-specific data driving in color-specific subpixels by differentiating overdriving, whereby response times of the color-specific subpixels are improved to be faster.

In addition, according to embodiments of the present disclosure, the controller, the data driver circuit, the display device, and the method of driving the same are able to perform data driving by differentiating overdriving, in consideration of the thicknesses of pigment layers of color-specific subpixels, whereby response times of the color-specific subpixels are improved to be faster.

Furthermore, according to embodiments of the present disclosure, the controller, the data driver circuit, the display device, and the method of driving the same are able to reduce differences in response times of color-specific subpixels due to different thicknesses of color-specific pigment layers.

BRIEF DESCRIPTION OF THE SEVERAL VIEWS OF THE DRAWINGS

The above and other objects, features and advantages of the present disclosure will be more clearly understood from the following detailed description when taken in conjunction with the accompanying drawings, in which.

DETAILED DESCRIPTION

Figure 1:
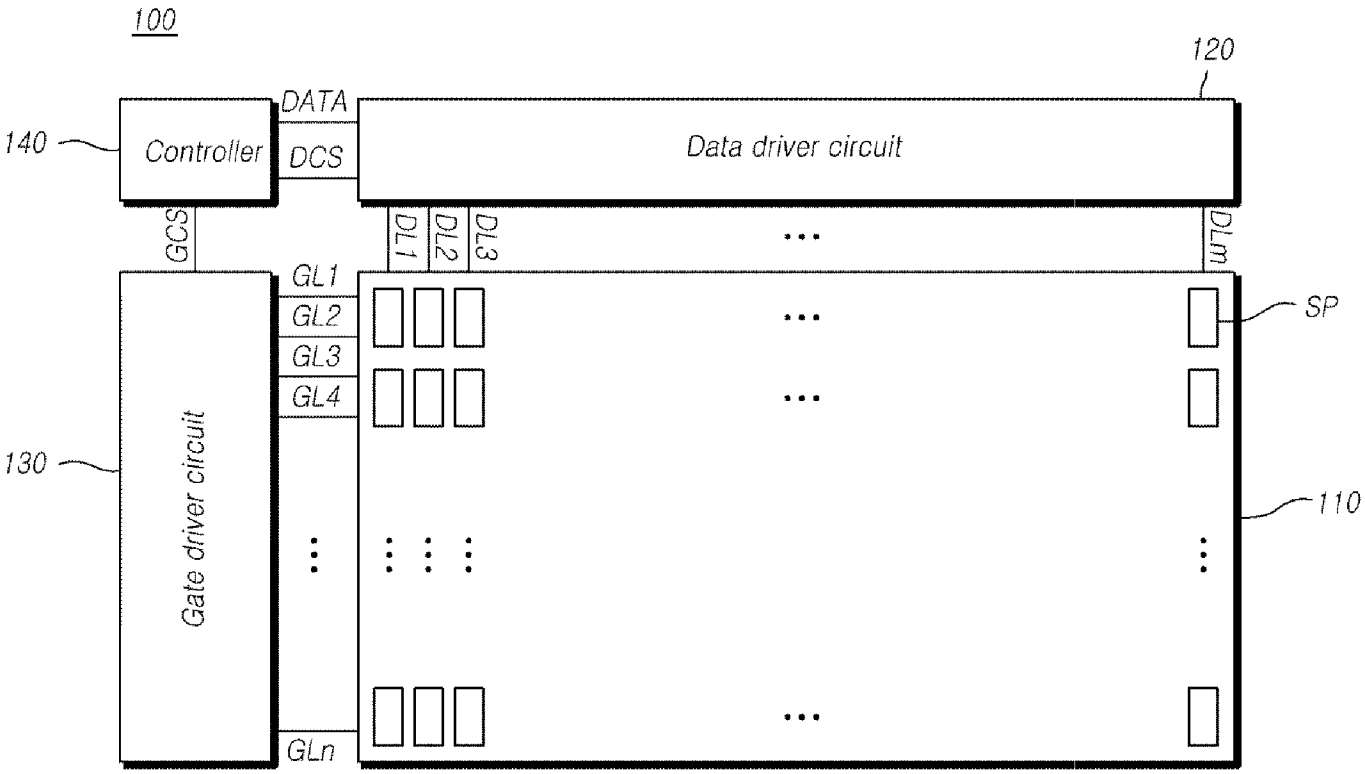
FIG. 1 is a schematic configuration view illustrating a display device according to exemplary embodiments.

Hereinafter, reference will be made to embodiments of the present disclosure in detail, examples of which are illustrated in the accompanying drawings. Throughout this document, reference should be made to the drawings, in which the same reference numerals and signs will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first," "second," "A," "B," "(a)," and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 is a schematic configuration view illustrating a display device 100 according to exemplary embodiments.

Referring to FIG. 1, the display device 100 according to exemplary embodiments includes a display panel 110 on which m number of data lines DL1 to DLm (where m is a natural number equal to or greater than 2) as well as n number of gate lines GL1 to GLn (where n is a natural number equal to or greater than 2) are disposed and a plurality of subpixels SP are formed, a data driver circuit 120 driving the plurality of data lines DL1 to DLm, a gate driver circuit 130 driving the plurality of gate lines GL1 to GLn, and a controller 140 controlling the data driver circuit 120 and the gate driver circuit 130.

The controller 140 controls the data driver circuit 120 and the gate driver circuit 130 by supplying a variety of control signals thereto.

The controller 140 starts scanning based on timing realized by each frame, converts image data input by an external source into a data signal format readable by the data driver circuit 120, outputs the converted image data, and at a suitable point in time, controls data processing in response to the scanning.

The controller 140 may be a timing controller used in typical display technology or a control device including a timing controller, the control device being able to perform other control functions.

The data driver circuit 120 drives the m number of data lines DL1 to DLm by supplying data voltages thereto. The data driver circuit 120 may be referred to interchangeably herein as a "source driver circuit."

The gate driver circuit 130 drives the n number of gate lines GL1 to GLn sequentially, by sequentially supplying scanning signals thereto. The gate driver circuit 130 may be referred to interchangeably herein as a "scanning driver circuit."

The gate driver circuit 130 sequentially supplies scanning signals, respectively having an on or off voltage, to the plurality of gate lines GL1 to GLn under the control of the controller 140.

When a specific gate line is opened by the gate driver circuit 130, the data driver circuit 120 converts image data DATA received from the controller 140 into data voltages corresponding to analog voltages and supplies the analog data voltages to the plurality of data lines DL1 to DLm.

Although the data driver circuit 120 is illustrated as being positioned on one side of (e.g., above or below) the display panel 110 in FIG. 1, the data driver circuit 120 may be positioned on both sides of (e.g., both above and below) the display panel 110 depending on the driving system, the design of the panel, and so on.

Although the gate driver circuit 130 is illustrated as being positioned on one side (e.g., to the left or to the right) of the display panel 110 in FIG. 1, the gate driver circuit 130 may be positioned on both sides (e.g., both to the left and to the right) of the display panel 110.

The controller 140 receives a variety of timing signals, including a vertical synchronization signal Vsync, a horizontal synchronization signal Hsync, an input data enable (DE) signal, and a clock (CLK) signal, as well as input image data, from an external source (e.g., an external host system).

The controller 140 not only outputs image data input from an external source by converting the image data into a data signal format readable by the data driver circuit 120, but also receives a variety of received timing signals, including a vertical synchronization signal Vsync, a horizontal synchronization signal Hsync, an input DE signal, and a clock signal, generates a variety of control signals, and outputs the variety of control signals to the data driver circuit 120 and the gate driver circuit 130 to control the data driver circuit 120 and the gate driver circuit 130.

For example, the controller 140 outputs a variety of gate control signals (GCSs), including a gate start pulse (GSP), a gate shift clock (GSC) signal, and a gate output enable (GOE) signal, to control the gate driver circuit 130.

Here, the GSP controls the operation start timing of one or more gate driver integrated circuits (ICs) of the gate driver circuit 130. The GSC signal is a clock signal commonly input to the gate driver ICs to control the shift timing of scanning signals (or gate pulses). The GOE signal designates the timing information of one or more gate driver ICs.

In addition, the controller 140 outputs a variety of data control signals (DCSs), including a source start pulse (SSP), a source sampling clock (SSC) signal, and a source output enable (SOE) signal, to control the data driver circuit 120.

Here, the SSP controls the data sampling start timing of one or more source driver ICs of the data driver circuit 120. The SSC signal is a clock signal controlling the data sampling timing of each of the source driver ICs. The SOE signal controls the output timing of the data driver circuit 120.

The data driver circuit 120 may include one or more source data driver circuit ICs (SDICs) to drive the plurality of data lines.

The SDICs may be connected to the bonding pads of the display panel 110 by tape automated bonding (TAB) or chip-on-glass (COG) bonding, may be directly disposed on the display panel 110, or in some cases, may be integrated with the display panel 110. In addition, the SDICs may be provided by chip-on-film (COF) processing, wherein the SDICs are mounted on a film connected to the display panel 100.

Each of the SDICs may include a shift register, a latch circuit, a digital-to-analog converter (DAC), an output buffer, and so on.

The gate driver circuit 130 may include one or more gate driver ICs (GDICs).

The GDICs may be connected to the bonding pads of the display panel 110 by tape automated bonding (TAB) or chip-on-glass (COG) bonding, may be implemented as a gate-in-panel (GIP)-type ICs directly disposed on the display panel 110, or in some cases, may be integrated with the display panel 110. In addition, the GDICs may be provided by chip-on-film (COF) processing, in which the GDICs are mounted on a film connected to the display panel 100.

Each of the GDICs may include a shift register, a level shifter, and so on.

The display panel 110 according to exemplary embodiments may include at least one source printed circuit board (S-PCB) required for the data driver circuit to be connected to the circuit thereof and a control printed circuit board (C-PCB) on which control components and a variety electronic devices are mounted.

The at least one S-PCB may have at least one SDIC mounted thereon, or at least one film having a SDIC mounted thereon may be connected to the at least one S-PCB.

The C-PCB may have the controller 140, a power controller (not shown), and so on mounted thereon. While the controller 140 controls the operations of the data driver circuit 120 and the gate driver circuit 130, the power controller supplies a variety of voltages or currents to the display panel 110, the data driver circuit 120, the gate driver circuit 130, and so on or controls a variety of voltages or currents to be supplied to the display panel 110, the data driver circuit 120, the gate driver circuit 130, and so on.

The circuit of the at least one S-PCB and the circuit of the C-PCB may be connected to each other via at least one connector.

The connector may be implemented as a flexible flat cable (FFC), a flexible printed circuit (FPC), or the like.

The at least one S-PCB and the C-PCB may be integrated as a single PCB.

The display device 100 according to exemplary embodiments may be one of various types of devices, such as a liquid crystal display (LCD) device, an organic light-emitting display device, and a plasma display device.

The plurality of subpixels SP disposed on the display panel 110 may be subpixels corresponding to c number of colors (where c is a natural number equal to or greater than 2).

For example, when c is 3, the plurality of subpixels SP disposed on the display panel 110 may be composed of three types of subpixels corresponding to three colors, including red, green, and blue.

In this case, each of the subpixels may correspond to a specific color among the three colors, and a color-specific pigment layer corresponding to the specific color may be provided in the area of each of the subpixels. Such pigment layers may be used in the formation of color filters, respectively corresponding to the specific color.

In another example, when c is 4, the plurality of subpixels SP disposed on the display panel 110 may be composed of four types of subpixels corresponding to four colors, including red, green, blue, and white.

In this case, color-specific pigment layers, respectively corresponding to a specific color, may be provided on the subpixels corresponding to the three colors except for white. Such color-specific pigment layers may be used in the formation of color filters, respectively corresponding to the specific color.

Figure 2:
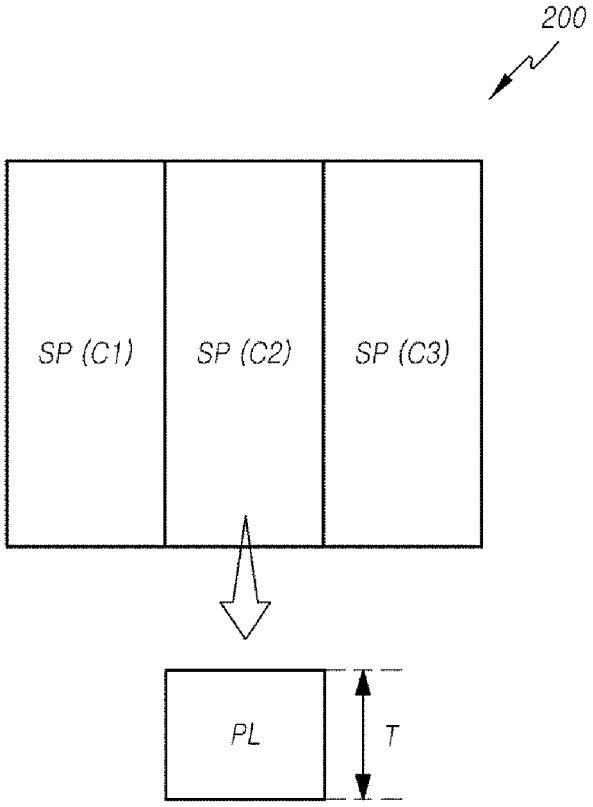
FIG. 2 is a schematic diagram illustrating a subpixel structure of the display device according to exemplary embodiments, as well as the thickness of a pigment layer in each subpixel.

FIG. 2 is a schematic diagram illustrating a subpixel structure of the display device 100 according to exemplary embodiments, as well as the thickness T of a pigment layer in each subpixel.

FIG. 2 illustrates a case in which a single pixel 200 is composed of three subpixels SP (C1), SP (C2), and SP (C3) when c is 3. SP (C1) is a subpixel corresponding to the first color C1 among three colors C1, C2, and C3. SP (C2) is a subpixel corresponding to the second color C2 among the three colors C1, C2, and C3. SP (C3) is a subpixel corresponding to the third color C3 among the three colors C1, C2, and C3.

Referring to FIG. 2, a pigment layer PL is provided in the area of each respective subpixel. The thickness T of the pigment layer PL may vary depending on the color filtering performance of a pigment.

For example, among three color filters including red, green, and blue filters, when a pigment for the red filter has the lowest level of color filtering performance and a pigment for the green filter has the highest level of color filtering performance, the thickness T of the pigment layer PL in the subpixel corresponding to red (or red subpixel) is set be the greatest and the thickness T of the pigment layer PL in the subpixel corresponding to green (or green subpixel) is set to be the lowest in order to compensate for the differences in the color filtering performance of the pigments for the red, green, and blue filters.

Since the thickness of the pigment layer PL varies according to the color of the subpixel as described above, color-specific subpixels may have different response times (RTs).

That is, since the pigment layer PL has a different thickness according to the color-specific subpixel, the color-specific subpixels may have different response times.

The term "response time (RT)" used herein may be defined as a period of time taken for a subpixel to be turned on. Specifically, the response time may be defined as a period of time taken for the luminance of a subpixel to change from 10% to 90%.

Figure 3:
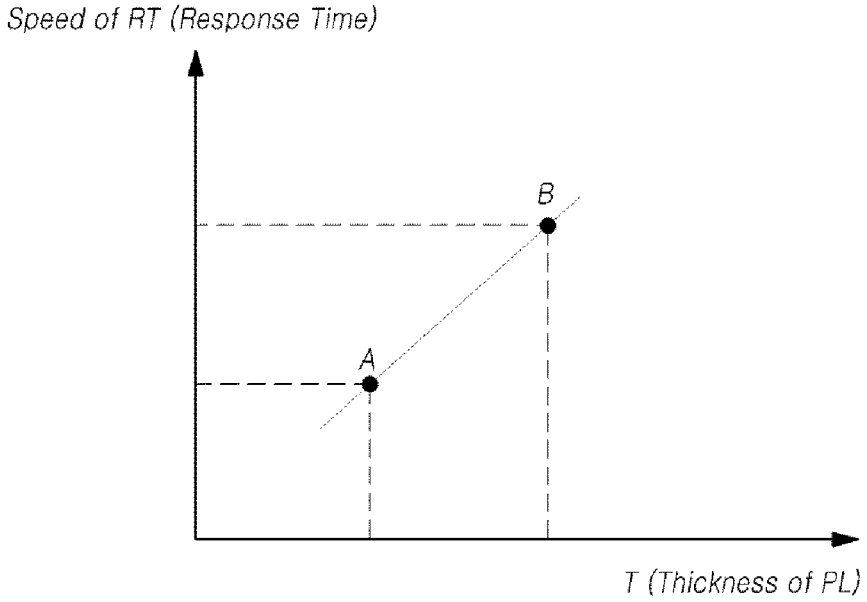
FIG. 3 is a graph illustrating the relationship between the thickness of the pigment layer and the response time in the display device according to exemplary embodiments.

FIG. 3 is a graph illustrating the relationship between the thickness T of the pigment layer PL and the speed of the response time RT in the display device 100 according to exemplary embodiments. The speed of the response time RT is shown on the x-axis of the graph and increases from slow (i.e., a high amount of time taken for the luminance of a subpixel to change from 10% to 90%) to fast (i.e., a low amount of time taken for the luminance of a subpixel to change from 10% to 90%) along an upward direction of the x-axis.

Referring to FIG. 3, the thickness T of the pigment layer PL may generally be proportional to the response time RT. That is, the thicker the thickness T of the pigment layer PL, the faster the response time (i.e., the lower the amount of time taken for the luminance of a corresponding subpixel to change from 10% to 90%).

Referring to FIG. 3, when the thickness T of a pigment layer PL of a subpixel B is greater than the thickness T of a pigment layer PL of a subpixel A, the subpixel B has a faster response time RT than the subpixel A.

Figure 4:
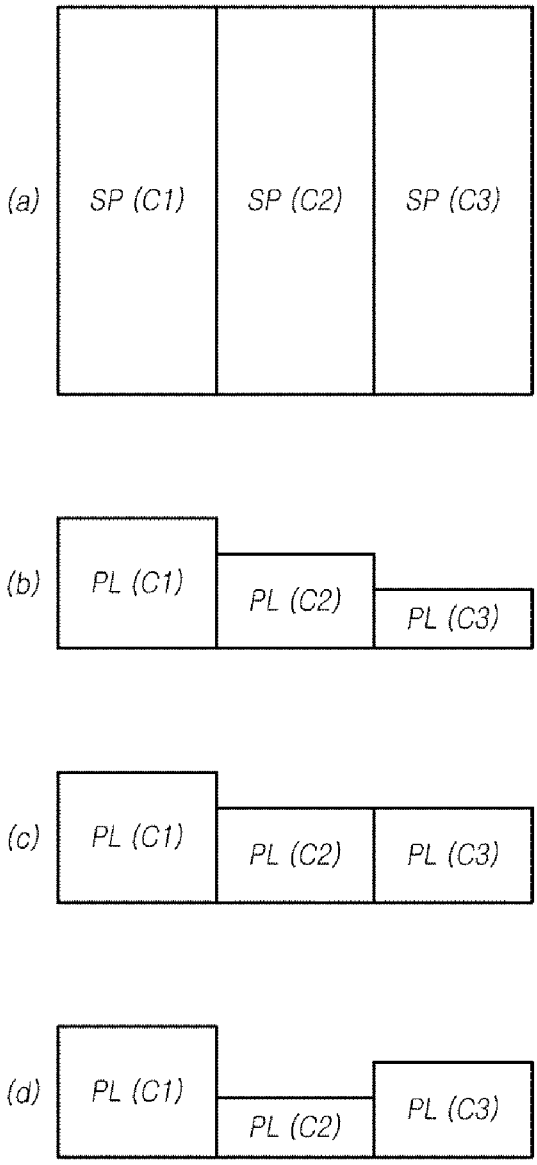
FIG. 4 is a schematic diagram illustrating the relationship between the thickness of the pigment layer and the response time in each subpixel of the display device according to exemplary embodiments.

FIG. 4 is a schematic diagram illustrating the relationship between the thickness T of the pigment layer PL and the response time RT in each subpixel of the display device 100 according to exemplary embodiments.

FIG. 4(*a*) illustrates a case in which a plurality of subpixels disposed on the display panel 110 according to exemplary embodiments are composed of three color-specific subpixels, i.e., three types of subpixels SP (C1), SP (C2), and SP (C3) corresponding to three colors C1, C2, and C3 (where c=3). Among pigment layers PL (C1), PL (C2), and PL (C3) provided in the subpixels SP (C1), SP (C2), and SP (C3) corresponding to the three colors C1, C2, and C3, the thickness of at least one pigment layer may be different from the thicknesses of the other pigment layers.

For example, as shown in FIG. 4(*b*), the thickness T of the pigment layer PL (C1) in the subpixel SP (C1) corresponding to the first color C1 may be the greatest, the thickness T of the pigment layer PC (C2) in the subpixel SP (C2) corresponding to the second color C2 may be the second greatest, and the thickness T of the pigment layer PL (C3) in the subpixel SP (C3) corresponding to the third color C3 may be the smallest (T: C1>C2>C3).

In this case, the response time RT of the subpixel SP (C1) corresponding to the first color C1 may be the fastest, the response time RT of the subpixel SP (C2) corresponding to the second color C2 may be the second fastest, and the response time RT of the subpixel SP (C3) corresponding to the third color C3 may be the slowest (speed of RT: C1>C2>C3).

In another example, shown in FIG. 4(*c*), the thickness T of the pigment layer PL (C1) in the subpixel SP (C1) corresponding to the first color C1 may be the greatest, while the thickness T of the pigment layer PL (C2) in the subpixel SP (C2) corresponding to the second color C2 may be equal to the thickness T of the pigment layer PL (C3) in the subpixel SP (C3) corresponding to the third color C3 (T: C1>C2=C3).

In this case, the response time RT of the subpixel SP (C1) corresponding to the first color C1 may be the fastest, while the response time RT of the subpixel SP (C2) corresponding to the second color C2 may be equal to the response time RT of the subpixel SP (C3) corresponding to the third color C3 (speed of RT: C1>C2=C3).

In a further example, shown in FIG. 4(*d*), the thickness T of the pigment layer PL (C1) in the subpixel SP (C1) corresponding to the first color C1 may be the greatest, the thickness T of the pigment layer PL (C3) in the subpixel SP (C3) corresponding to the third color C3 may be the second greatest, and the thickness T of the pigment layer PC (C2) in the subpixel SP (C2) corresponding to the second color C2 may be the smallest (T: C1>C3>C2).

In this case, the response time RT of the subpixel SP (C1) corresponding to the first color C1 may be the fastest, the response time RT of the subpixel SP (C3) corresponding to the third color C3 may be the second fastest, and the response time RT of the subpixel SP (C2) corresponding to the second color C2 may be the slowest (speed of RT: C1>C3>C2).

In addition to the examples as described above, the relationship of the thicknesses of the color-specific pigment layers and the relationship of response times of the color-specific subpixels may have a variety of other examples.

As described above, when the color-specific pigment layers PL are designed to have different thicknesses T to improve the color filtering performance, the color-specific subpixels may consequently have different response times.

Such different response times of the color-specific subpixels may cause color blurring on the screen, thereby lowering image quality. This phenomenon may be particularly significant during video playback.

In this regard, exemplary embodiments provide an adaptive overdriving control method able to reduce differences in response times of color-specific subpixels when executing overdriving on data regardless of the different thicknesses of color-specific pigment layers.

Hereinafter, an adaptive overdriving control method for compensating for differences in response times of color-specific subpixels according to different thicknesses of color-specific pigment layers will be described. Herein, a case in which c is 3 will be taken. That is, it will be assumed that color-specific subpixels corresponding to three colors (e.g., red, green, and blue) are disposed on the display panel 110.

Figure 5:
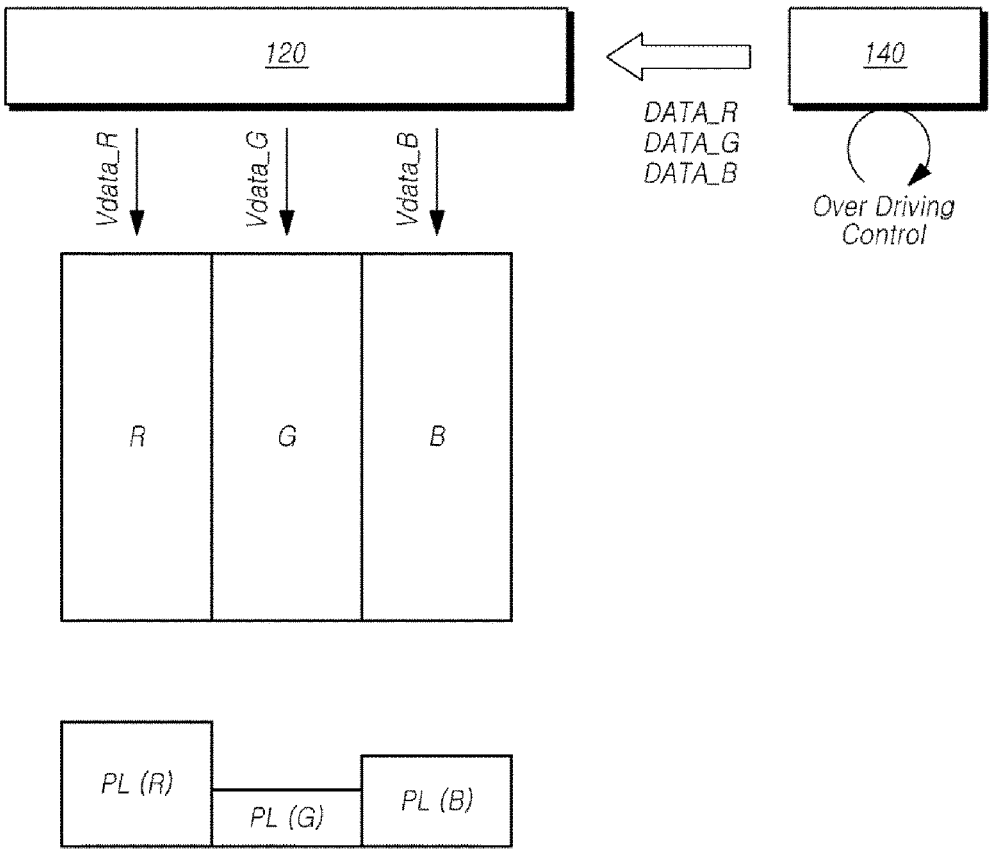
FIG. 5 is a schematic diagram illustrating an adaptive overdriving control method for compensating for differences in response times of color-specific subpixels in the display device according to exemplary embodiments.
Figure 6:
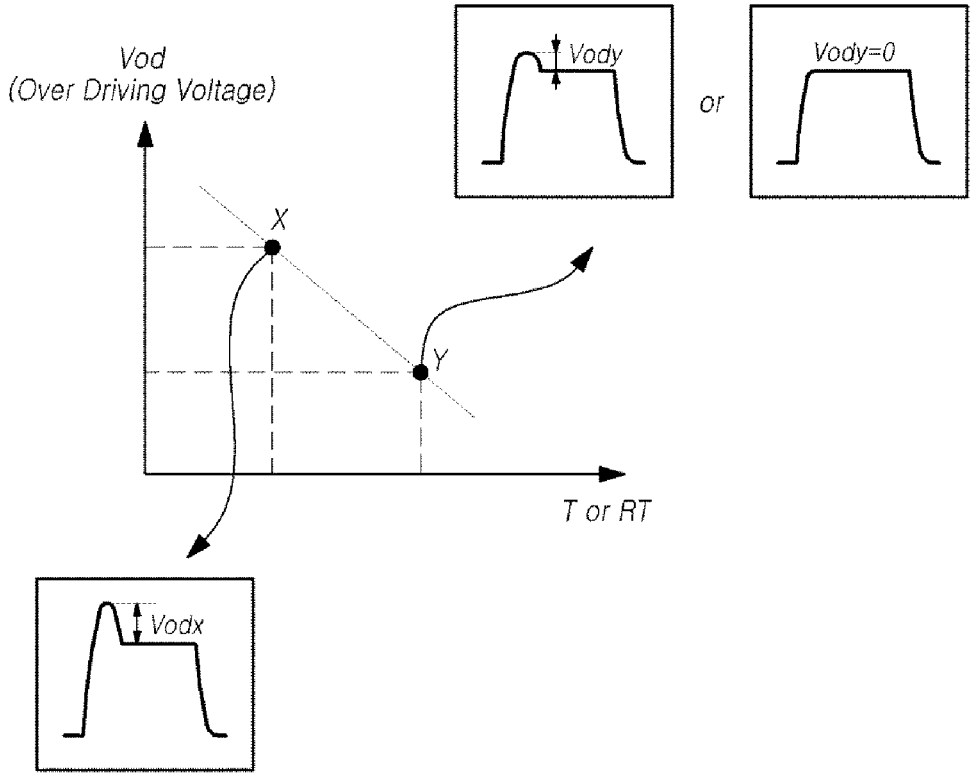
FIG. 6 is a graph illustrating overdriving voltages for color-specific subpixels in accordance with embodiments of the adaptive overdriving control method of FIG. 5.

FIG. 5 is a schematic diagram, and FIG. 6 is a graph, illustrating an adaptive overdriving control method for compensating for differences in response times of color-specific subpixels in the display device 100 according to exemplary embodiments.

The display panel 110 according to exemplary embodiments is provided with color-specific subpixels corresponding to three colors (red, green, and blue; where c=3), in which a pigment layer in at least one color-specific subpixel has a different thickness from the other pigment layers in the other color-specific subpixels.

In the illustration of FIG. 5, a pigment layer PL (R) in a red subpixel R (i.e., a subpixel corresponding to red), a pigment layer PL (G) in a green subpixel G (i.e., a subpixel corresponding to green), and a pigment layer PL (B) in a blue subpixel B (i.e., a subpixel corresponding to blue) have different thicknesses T.

More specifically, the thickness T of the pigment layer PL (R) in the red subpixel R is the greatest, the thickness T of the pigment layer PL (B) in the blue subpixel B is the second greatest, and the thickness T of the pigment layer PL (G) in the green subpixel G is the smallest (T: R>B>G).

As described above, the thickness T of a pigment layer PL in at least one color-specific subpixel is set to be different from the thicknesses of the other pigment layers in the other color-specific subpixels. This can consequently compensate for differences in the color filtering performance of color-specific pigments, thereby improving color gamut.

In the display panel 110 according to exemplary embodiments, subpixels corresponding to at least one color among the plurality of subpixels corresponding to the three colors (c=3) may have different response times RT from the other subpixels corresponding to the other colors.

In the illustration of FIG. 5, the red subpixel R, the green subpixel G, and the blue subpixel B may have different response times RT.

More specifically, when overdriving control is not applied, the red subpixel R has the fastest response time RT, the blue subpixel B has the second fastest response time RT, and the green subpixel G has the slowest response time RT (speed of RT: R>B>G).

Since the pigment layer PL in at least one color-specific subpixel is designed to have a different thickness from the other pigment layers in the other color-specific subpixels in order to compensate for differences in the color filtering performance of color-specific pigments, the color-specific subpixels may have undesirable differences in response times, thereby undesirably lowering image quality.

As described above, considering differences in response times of color-specific subpixels according to different thicknesses of color-specific pigment layers, the controller 140 can determine whether or not to apply overdriving to color-specific image data on different bases and/or can control color-specific image data to be overdriven at different overdriving levels (or degrees of overdriving).

More specifically, the controller 140 converts image data corresponding to one or more (e.g., up to c−1) number of colors among c number of colors into overdriven image data and provide the overdriven image data to the data driver circuit 120.

For example, in one or more embodiments, the controller 140 applies overdriving to image data corresponding to two colors (green and blue) among three colors (red, green, and blue). Specifically, the controller 140 converts the image data corresponding to the two colors (green and blue) into overdriven image data DATA_G and DATA_B and provides the overdriven image data DATA_G and DATA_B to the data driver circuit 120 while providing image data DATA_R corresponding to the remaining color (red) to the data driver circuit 120 without overdriving.

Alternatively, in some embodiments, the controller 140 applies overdriving to all image data corresponding to c number of colors. Specifically, the controller 140 converts image data corresponding to c number of colors into overdriven image data having different overdriving levels (or different degrees of overdriving) according to colors and then supplies the overdriven image data to the data driver circuit 120.

For example, in one or more embodiments, the controller 140 applies overdriving to all image data corresponding to three colors (red, green, and blue). Specifically, the controller 140 converts image data corresponding to three colors (red, green, and blue) into overdriven image data DATA_R, DATA_G, and DATA_B having different overdriving levels (or different degrees of overdriving) according to colors and then supplies the overdriven image data to the data driver circuit 120.

As described above, the controller 140 can compensate for differences in response times of the color-specific subpixels according to different thicknesses of the color-specific pigment layers by determining whether or not to apply overdriving to color-specific image data on different bases or controlling color-specific image data to be overdriven at different overdriving levels.

Referring to FIG. 5, the data driver circuit 120 receives the color-specific image data DATA_R, DATA_G, and DATA_B from the controller 140 and supplies color-specific data voltages Vdata_R, Vdata_G, and Vdata_B, obtained through digital-to-analog conversion, to the color-specific subpixels.

Since the data driver circuit 120 supplies the data voltages Vdata_R, Vdata_G, and Vdata_B, converted from the overdriving-controlled color-specific image data DATA_R, DATA_G, DATA_B received from the controller 140, the data driver circuit 120 supplies data voltages overdriven by overdriving voltages to subpixels corresponding to one or more (e.g., up to c−1) number of colors or supplies overdriven data voltages to subpixels corresponding to c number of colors. Here, a data voltage overdriven by another overdriving voltage can be supplied to subpixels corresponding to at least one color among the c number of subpixels.

As described above, the display device 100 according to exemplary embodiments supplies overdriven data voltages to subpixels corresponding to a predetermined color or subpixels corresponding to all colors using the data driver circuit 120. Here, the display device 100 can supply a data voltage overdriven by another overdriving voltage to subpixels belonging to at least one type (e.g., to at least one color type). This can consequently compensate for differences in response times of color-specific subpixels depending on differences in thicknesses of color-specific pigment layers. As such the speed of the response time RT may be substantially equalized among the color-specific subpixels (speed of RT: R≈B≈G).

Referring to FIG. 6, according to the adaptive overdriving control method for compensating for differences in response times of color-specific subpixels in the display device 100 according to exemplary embodiments, a data voltage overdriven by a higher overdriving voltage Vod is supplied to a subpixel having a smaller pigment layer thickness T among subpixels corresponding to c number of colors.

In other words, according to the adaptive overdriving control method for compensating for differences in response times of color-specific subpixels in the display device 100 according to exemplary embodiments, the subpixel having a slower response time RT due to the smaller thickness T of the pigment layer PL thereof among subpixels corresponding to c number of colors can be supplied with a data voltage overdriven by a higher overdriving voltage.

The term "overdriving voltage" used herein may mean a voltage that is higher than a data voltage for an image to be reproduced in a target subpixel by a predetermined level during rising of a voltage signal waveform. The overdriving voltage may be a voltage equal to or higher than 0 V.

Referring to FIG. 6, an overdriving voltage Vodx in a data voltage waveform supplied to a color-specific subpixel X in which a pigment layer PL has a smaller thickness T is higher than an overdriving voltage Vody in a data voltage waveform supplied to a color-specific subpixel Y in which a pigment layer PL has a greater thickness T.

Referring to FIG. 6, the overdriving voltage Vodx in the data voltage waveform supplied to the subpixel X having a slower response time RT is higher than the overdriving voltage Vody in the data voltage waveform supplied to the subpixel Y having a faster response time RT.

As described above, the color-specific subpixel X having a slower response time RT due to the smaller thickness T of the pigment layer PL is supplied with a data voltage overdriven by a higher overdriving voltage Vodx, whereby the response time RT thereof can be improved. Consequently, the difference in response times between the subpixels X and Y due to the different thicknesses of the pigment layers PL thereof can be reduced.

Figure 7:
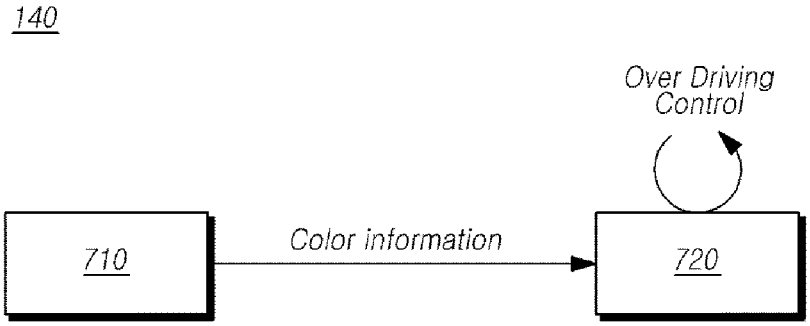
FIG. 7 is a schematic diagram illustrating a controller providing an adaptive overdriving control method for compensating for differences in response times of color-specific subpixels in the display device according to exemplary embodiments.
Figure 8:
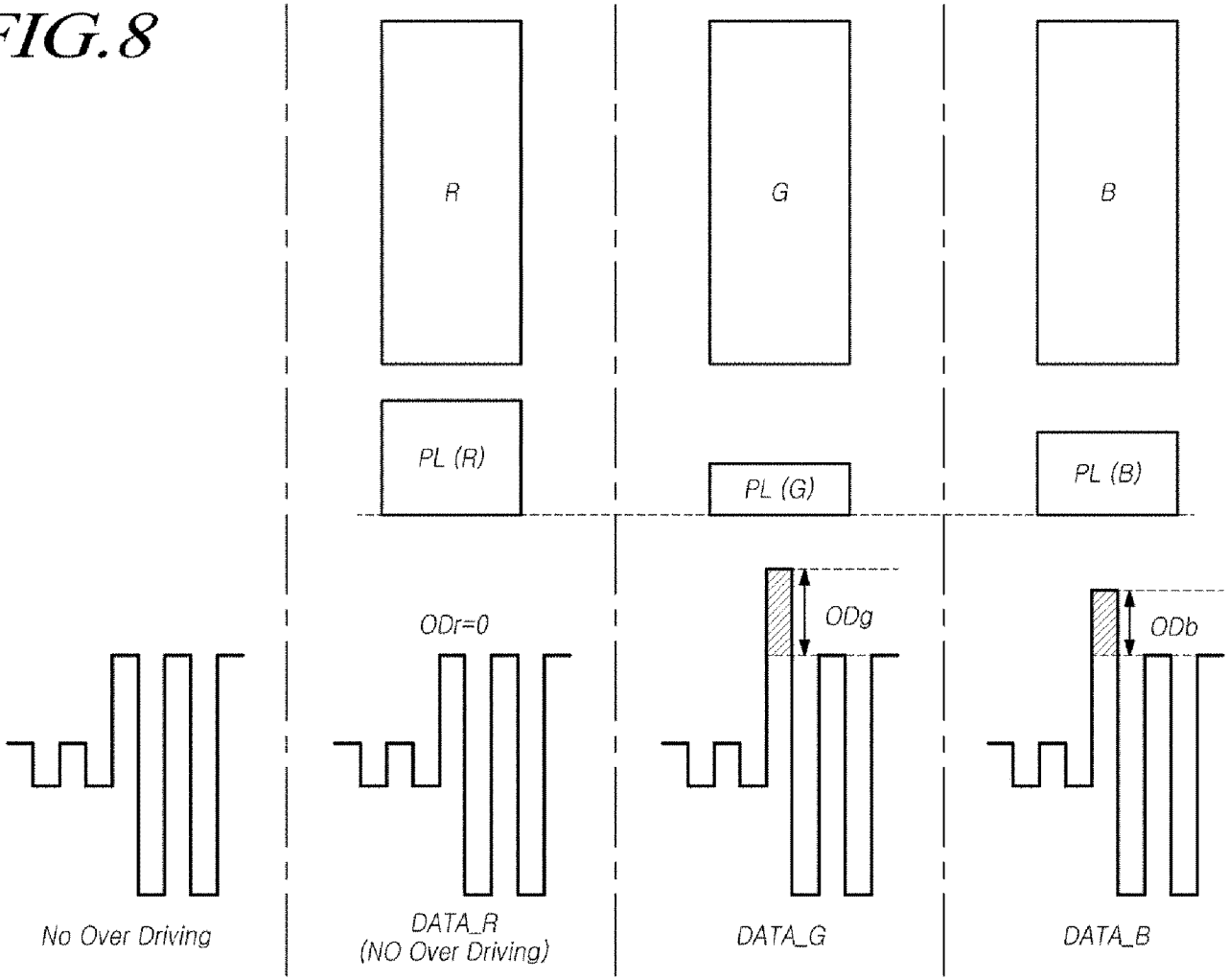
FIG. 8 and FIG. 9 are schematic diagrams illustrating color-specific image data that have been overdriving-controlled according to colors by the adaptive overdriving control method for compensating for differences in response times of color-specific subpixels in the display device according to exemplary embodiments.
Figure 9:
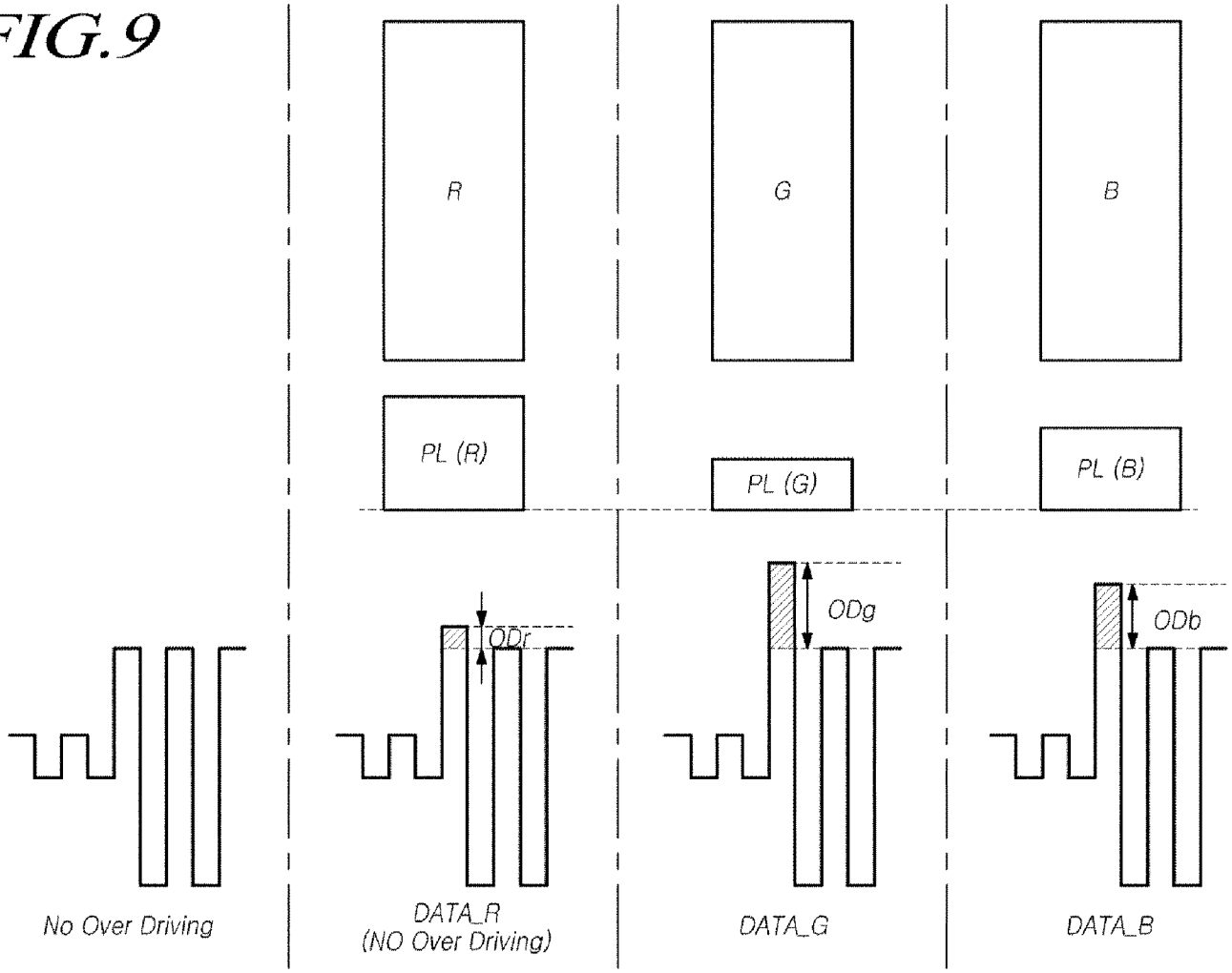

FIG. 7 is a schematic diagram illustrating the controller 140 providing an adaptive overdriving control method for compensating for differences in response times of color-specific subpixels in the display device 100 according to exemplary embodiments, and FIG. 8 and FIG. 9 are schematic diagrams illustrating color-specific image data that have been overdriving-controlled according to colors by the adaptive overdriving control method for compensating for differences in response times of color-specific subpixels in the display device 100 according to exemplary embodiments.

Referring to FIG. 7, the controller 140 of the display device 100 according to exemplary embodiments can provide the adaptive overdriving control method to compensate for differences in response times of color-specific subpixels.

The controller 140 includes a color information storage device 710 (which may be, for example, any computer-readable storage medium operable to store color information) containing information about the colors of a plurality of subpixels disposed on the display panel 110 and an overdriving controller 720 converting image data regarding the plurality of subpixels into overdriving image data by referring to the information about the colors of the plurality of subpixels and outputting the overdriving image data.

The overdriving controller 720 converts the image data regarding the plurality of subpixels into the overdriving image data, by referring to the information about the colors of the plurality of subpixels stored in the color information storage device 710, and based on predetermined color-specific overdriving levels (that may be digital values corresponding to overdriving voltages).

The use of the controller 140 makes it possible to control the overdriving level (or the degree of overdriving) of image data according to the color of each of the subpixels.

The overdriving level of a specific color among color-specific image data, i.e., subpixel-specific image data overdriving-controlled by the overdriving controller 720, may be zero (0).

Here, the overdriving level OD may mean a value greater than the value of basic image data for an image to be reproduced in the corresponding subpixel.

Referring to FIG. 8, the overdriving controller 720 converts image data corresponding to two colors (green and blue) among three colors (red, green, and blue) into overdriven image data DATA_G and DATA_B by applying overdriving to the image data corresponding to two colors (green and blue) while providing non-overdriven image data DATA_R corresponding to the remaining color (red) to the data driver circuit 120.

Here, the overdriving level ODr of the image data DATA_R for a red subpixel is zero (0).

In addition, the overdriving level ODg of the image data DATA_G for a green subpixel and the overdriving level ODb of the image data DATA_B for a blue subpixel may be the same or different values, none of which is zero (0).

Here, an overdriving level for at least one color among color-specific image data, i.e., subpixel-specific image data overdriving-controlled by the overdriving controller 720, may differ from overdriving levels for the other colors.

In this regard, the overdriving controller 720 applies overdriving to all image data corresponding to three colors (red, green, and blue), such that the image data corresponding to three colors (red, green, and blue) are converted into overdriven image data DATA_R, DATA_G, and DATA_B having different color-specific overdriving levels ODr, ODg, and ODb.

Since the thickness of a pigment layer PL (G) of the green subpixel G is the smallest, the response time of the green subpixel G is the slowest. Since it is required to improve the response time for green by a highest level, the overdriving level ODg for green is set to be the highest.

In contrast, since the thickness of a pigment layer PL (R) of the red subpixel R is the greatest, the response time of the red subpixel R is the fastest. Since the response time for red may be improved by a lowest level, the overdriving level ODg for green is set to be the greatest.

The use of the controller 140 as described above makes it possible to control the overdriving levels (or the degrees of overdriving) of subpixel-specific image data. Thus, subpixels having slower response times due to thinner pigment layers can be supplied with image data having greater overdriving levels, whereby the slower response times can be improved to be faster. This can consequently reduce differences in the response times of the color-specific subpixels.

Figure 10:
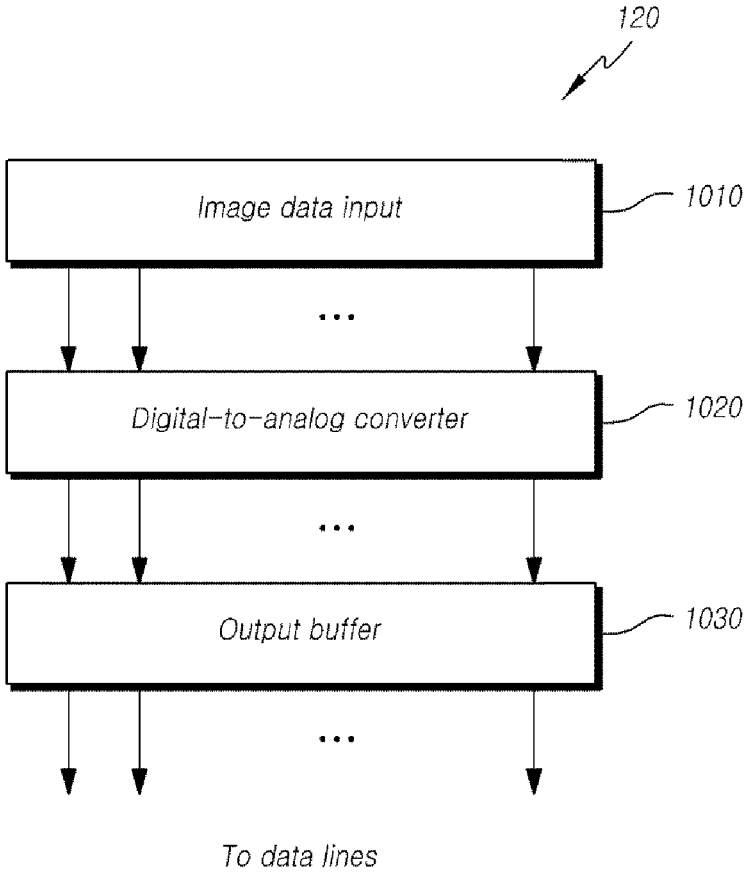
FIG. 10 is a schematic block diagram illustrating the data driver circuit providing the adaptive overdriving control method for compensating for differences in response times of color-specific subpixels in the display device according to exemplary embodiments.
Figure 11:
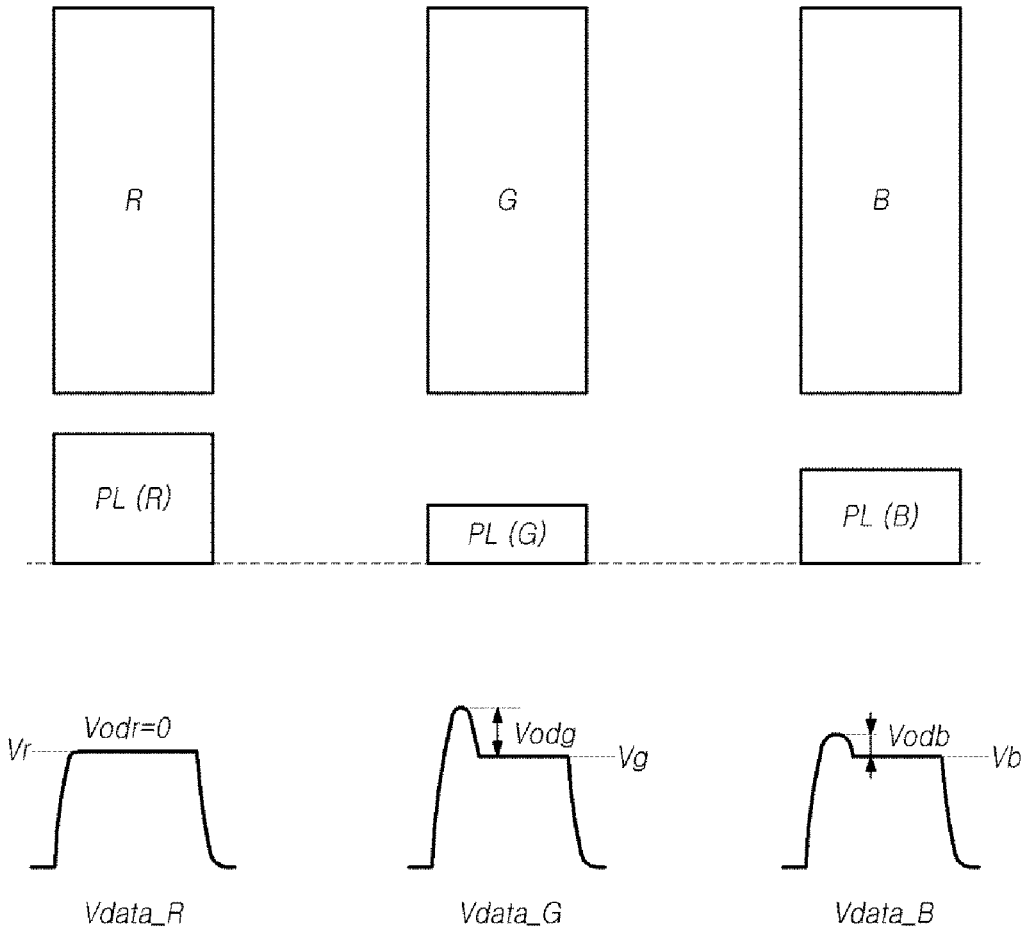
FIG. 11 and FIG. 12 are schematic diagrams illustrating color-specific data voltages overdriven according to colors by the adaptive overdriving control method for compensating for differences in response times of color-specific subpixels in the display device according to exemplary embodiments.
Figure 12:
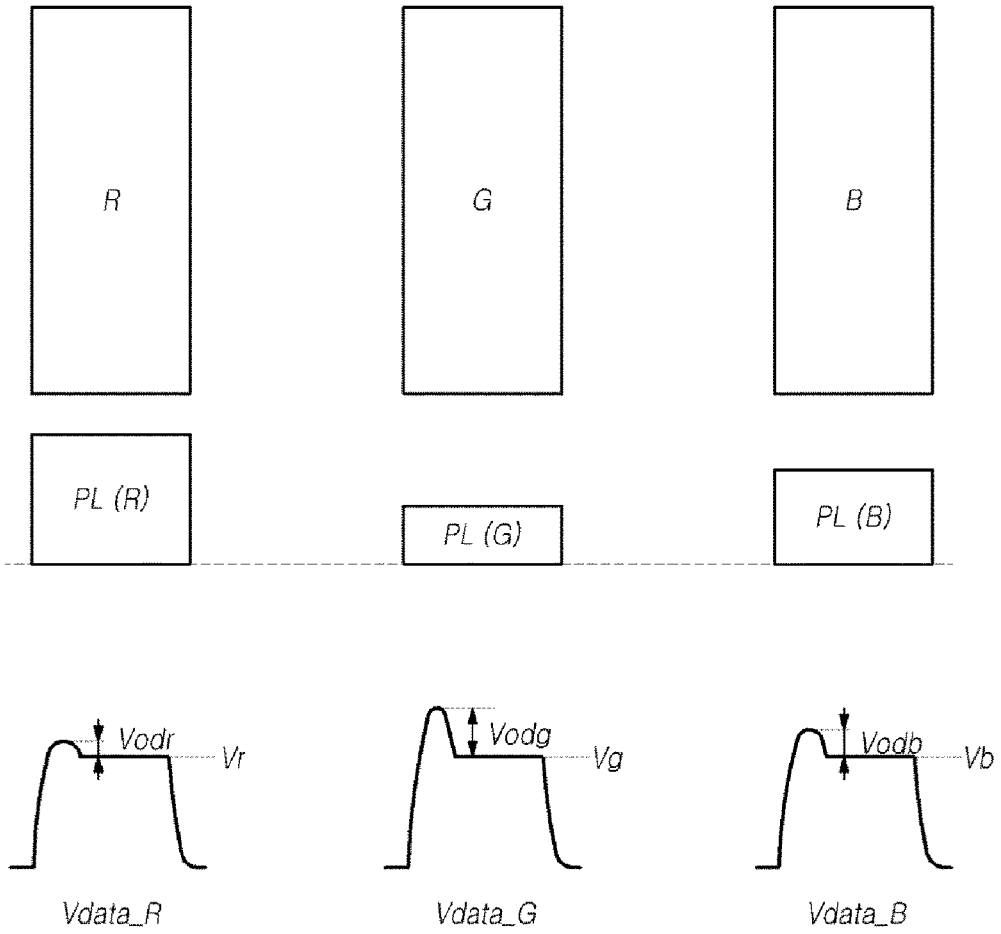

FIG. 10 is a schematic diagram illustrating the data driver circuit 120 providing the adaptive overdriving control method for compensating for differences in response times of color-specific subpixels in the display device 100 according to exemplary embodiments, and FIG. 11 and FIG. 12 are schematic diagrams illustrating color-specific data voltages overdriven according to colors by the adaptive overdriving control method for compensating for differences in response times of color-specific subpixels in the display device 100 according to exemplary embodiments.

Referring to FIG. 10, the data driver circuit 120 of the display device 100 according to exemplary embodiments can provide an adaptive overdriving control method to compensate for differences in response times of color-specific subpixels.

The data driver circuit 120 includes an image data input section 1010 receiving image data, a digital-to-analog converter 1020 converting the image data into data voltages corresponding to analog voltages, and an output buffer 1030 outputting the data voltages to data lines.

The data voltages output by the output buffer 1030 are determined by the image data input into the image data input section 1010 under the overdriving control of the controller 140.

Then, in one or more embodiments, the output buffer 1030 outputs the data voltages overdriven by overdriving voltages to data lines connected to subpixels corresponding to one to c−1 number of colors among subpixels corresponding to c number of colors (where c is a natural number equal to or greater than 2).

For example, referring to FIG. 11, the output buffer 1030 outputs data voltages Vdata_G and Vdata_B overdriven by overdriving voltages Vodg and Vodb to data lines connected to subpixels G and B corresponding to one or two colors (e.g., green and blue) among data lines connected to the subpixels corresponding to c number of colors (e.g., red, green, and blue; where c=3) while outputting non-overdriven data voltages Vdata_R (Vodr=0) to data lines connected to subpixels R corresponding to the remaining two or one color (e.g., red).

In addition, in one or more embodiments, the output buffer 1030 outputs overdriven data voltages to data lines connected to the subpixels corresponding to c number of colors disposed on the display panel 110 while outputting data voltages overdriven by other overdriving voltages to data lines connected to subpixels corresponding to at least one color.

For example, referring to FIG. 12, the output buffer 1030 outputs data voltages Vdata_R, Vdata_G, and Vdata_B overdriven by overdriving voltages Vodr, Vodg, and Vodb to all data lines connected to subpixels R, G, and B corresponding to three colors (where c=3).

Referring to FIG. 12, at least one of the overdriving voltages Vodr, Vodg, and Vodb of the overdriven data voltages Vdata_R, Vdata_G, and Vdata_B, output to the data lines connected to the subpixels R, G, and B corresponding to three colors (where c=3), may have a different level from the other overdriving voltages.

In the illustration of FIG. 12, the level of the overdriving voltage Vodg of the overdriven data voltage Vdata_G, output to the data lines connected to the green subpixels G, is the highest.

The level of the overdriving voltage Vodb of the overdriven data voltage Vdata_B, output to the data lines connected to the blue subpixels B, is the second highest.

In addition, the level of the overdriving voltage Vodr of the overdriven data voltage Vdata_R, output to the data lines connected to the red subpixels R, is the lowest.

Referring to FIG. 11 and FIG. 12, the data voltages Vdata_R, Vdata_G, Vdata_B overdriven by the overdriving voltages Vodr, Vodg, and Vodb can have voltage waveforms that are higher than data voltages Vr, Vg, Vb for images to be reproduced in corresponding subpixels, by the levels of the overdriving voltages Vodr, Vodg, and Vodb, during a rising portion (e.g., a rising edge) of the signal waveforms, as shown.

The use of the data driver circuit 120 as described above makes it possible to control overdriving levels (or overdriving voltages) of data voltages to be supplied to subpixels according to the colors of the subpixels, thereby improving response times of the subpixels to be faster.

Hereinafter, an adaptive overdriving control method that the display device 100 as described above provides to compensate for differences in response times of color-specific subpixels will be described in brief.

Figure 13:
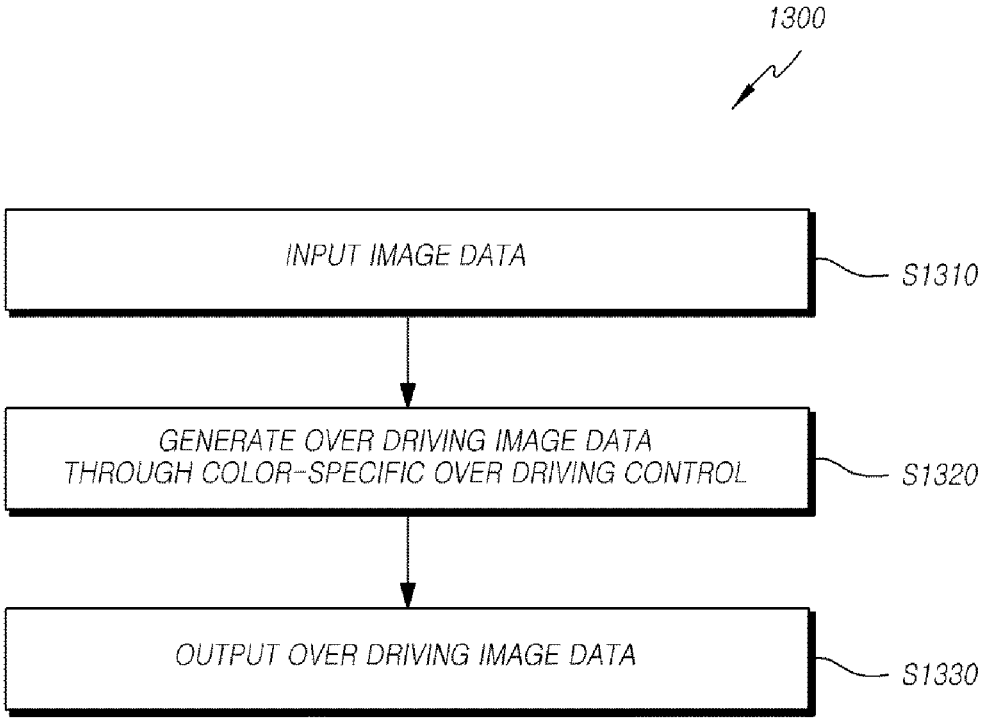
FIG. 13 is a flowchart illustrating a driving method for the display device according to exemplary embodiments to provide an adaptive overdriving control method.
Figure 14:
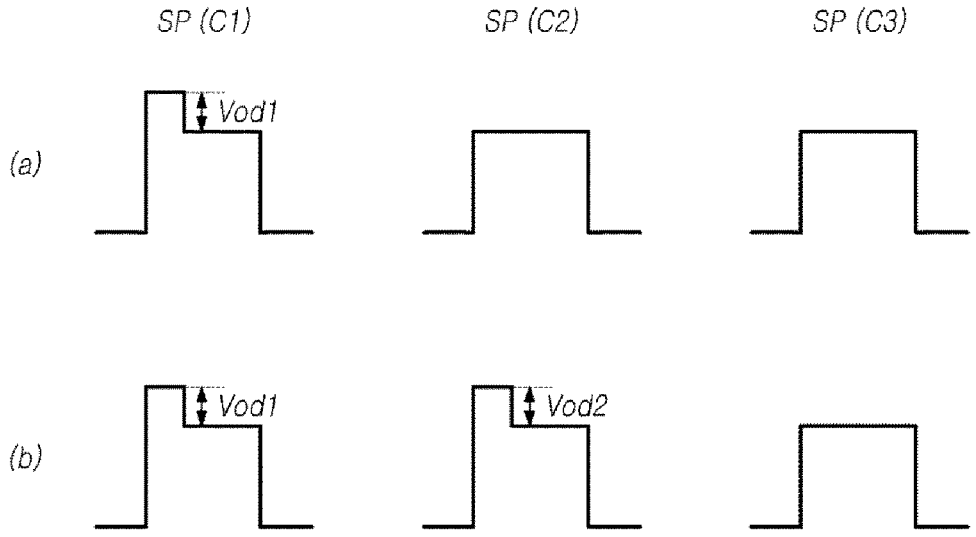
FIG. 14 and FIG. 15 are schematic diagrams illustrating color-specific data voltages overdriving-controlled according to colors by the driving method of the display device according to exemplary embodiments in an assumption that rising times and falling times are very short.
Figure 15:
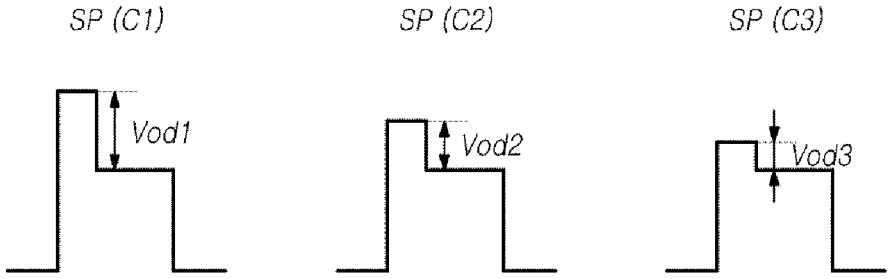

FIG. 13 is a flowchart illustrating a driving method 1300 for the display device 100 according to exemplary embodiments to provide an adaptive overdriving control method, and FIG. 14 and FIG. 15 are schematic diagrams illustrating color-specific data voltages overdriving-controlled according to colors by the driving method of the display device 100 according to exemplary embodiments in an assumption that rising times and falling times are very short.

Referring to FIG. 13, the driving method 1300 of the display device 100 according to exemplary embodiments includes: step S1310 of receiving, in the controller 140, image data for a plurality of subpixels disposed on the display panel 110; step S1320 of converting, in the controller 140, the image data for the plurality of subpixels into overdriving image data, based on information about the colors of the plurality of subpixels and color-specific overdriving levels (corresponding to overdriving voltages); and step S1330 of outputting, in the controller 140, the overdriving image data to the data driver circuit 120.

According to the driving method 1300 as described above, the display device 100 according to exemplary embodiments supplies the overdriven image data to subpixels corresponding to a specific color or subpixels corresponding to all colors. At the same time, the display device 100 supplies image data overdriven at different overdriving levels (different degrees of overdriving) to subpixels belonging to a single type. This can consequently compensate for differences in response times of the color-specific subpixels due to different thicknesses of the color-specific pigment layers, thereby improving overall response times to be faster.

In step S1320 in which the overdriving image data are generated, an overdriving level for a specific color among overdriving levels for c number of colors (e.g., C1, C2, and C3) may be zero (0).

For example, in one or more embodiments, referring to FIG. 14(*a*), the data driver circuit 120 outputs data voltages overdriven by an overdriving voltage Vod1 to a subpixel SP (C1) corresponding to a single color C1 among three colors C1, C2, and C3 (where c=3) while outputting non-overdriven data voltages (or data voltages in which an overdriving voltage is 0 V) to subpixels SP (C2) and SP (C3) corresponding to the remaining two colors.

Alternatively, in one or more embodiments, referring to FIG. 14(*b*), the data driver circuit 120 outputs data voltages overdriven by overdriving voltages Vod1 and Vod2 to subpixels SP (C1) and SP (C2) corresponding to two colors C1 and C2 among three colors C1, C2, and C3 (where c=3) while outputting a non-overdriven data voltage (or a data voltage in which an overdriving voltage is 0 V) to a subpixel SP (C3) corresponding to the remaining single color C3.

As described above, it is possible to supply overdriven image data to subpixels corresponding to specific colors and having thin pigment layers PL, thereby accelerating response times of the subpixels that would otherwise be slow due to the thin pigment layers PL.

In step S1320 in which the overdriving image data are generated, among overdriving levels (corresponding to overdriving voltages) for colors, an overdriving level for at least one color is different from overdriving levels for the other colors.

For example, in one or more embodiments, referring to the illustration of FIG. 15, the data driver circuit 120 outputs data voltages overdriven by overdriving voltages Vod1, Vod2, and Vod3, none of which is 0, to all subpixels SP (C1), SP (C2), and SP (C3) corresponding to three colors C1, C2, and C3 (where c=3).

Here, among the overdriving voltages Vod1, Vod2, and Vod3 for the subpixels SP (C1), SP (C2), and SP (C3) corresponding to three colors C1, C2, and C3 (where c=3), at least one overdriving voltage is different from the other voltages.

FIG. 15 illustrates a case in which different overdriving voltages Vod1, Vod2, and Vod3 are applied to the subpixels SP (C1), SP (C2), and SP (C3) corresponding to three colors C1, C2, and C3 (where c=3) (Vod1≠Vod2≠Vod3).

As described above, it is possible to overdrive image data at different levels according to the thicknesses of the pigment layers PL in the color-specific subpixels, thereby reducing differences in response times due to the different thicknesses of the pigment layers PL.

The display device 100 providing the adaptive overdriving control method to compensate for differences in response times of color-specific subpixels due to different thicknesses of color-specific pigment layers as described above includes: the display panel 110 on which m number of data lines (where m is a natural number equal to or greater than 2) and n number of gate lines (where n is a natural number equal to or greater than 2) are disposed and a plurality of subpixels are formed; the data driver circuit 120 supplying data voltages to the subpixels through the m number of data lines; and the controller 140 providing image data to the data driver circuit 120 and controlling the data driver circuit 120.

According to the adaptive overdriving control method, the data driver circuit 120 can supply the subpixels with data voltages overdriven differently according to the thicknesses T of the pigment layers in the subpixels.

It is possible to control overdriving levels (overdriving voltages) for data voltages to be supplied to subpixels based on the colors of the subpixels, thereby improving response times in the subpixels to be faster.

Regarding the relationship between the overdriving level of a data voltage supplied to a subpixel and the thickness T of a pigment layer in the subpixel, the overdriving level (or overdriving voltage) of the data voltage supplied to the subpixel is inversely proportional to the thickness T of the pigment layer.

As described above, when the response time RT of a color-specific subpixel is slower due to the smaller thickness T of the pigment layer PL, a data voltage overdriven by a higher overdriving voltage Vod is supplied to the subpixel, thereby improving the response time RT to be faster. This can consequently reduce differences in response times of subpixels due to different thicknesses of pigment layers PL in the subpixels.

According to the exemplary embodiments as set forth above, the controller 140, the data driver circuit 120, the display device 100, and the method of driving the same are able to perform color-specific data driving in color-specific subpixels by differentiating overdriving, whereby response times of the color-specific subpixels are improved to be faster.

In addition, according to the exemplary embodiments, the controller 140, the data driver circuit 120, the display device 100, and the method of driving the same are able to perform data driving by differentiating overdriving, in consideration of the thicknesses of pigment layers of color-specific subpixels, whereby response times of the color-specific subpixels are improved to be faster.

Furthermore, according to the exemplary embodiments, the controller 140, the data driver circuit 120, the display device 100, and the method of driving the same are able to reduce differences in response times of color-specific subpixels due to different thicknesses of color-specific pigment layers.

The foregoing descriptions and the accompanying drawings have been presented in order to explain the certain principles of the present disclosure. A person skilled in the art to which the disclosure relates could make many modifications and variations by combining, dividing, substituting for, or changing the elements without departing from the principle of the disclosure. The foregoing embodiments disclosed herein shall be interpreted as illustrative only but not as limitative of the principle and scope of the disclosure. It should be understood that the scope of the disclosure shall be defined by the appended Claims and all of their equivalents fall within the scope of the disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device, comprising:

a display panel including:

m number of data lines, where m is a natural number equal to or greater than 2, n number of gate lines, where n is a natural number equal to or greater than 2, and a plurality of subpixels, each of the subpixels corresponding to one of c number of colors, where c is a natural number equal to or greater than 2;

a data driver circuit supplying data voltages to the subpixels through the m number of data lines; and a controller providing image data to the data driver circuit and controlling the data driver circuit, wherein the data driver circuit supplies the data voltages to a first portion of the subpixels as overdriven data voltages, the overdriven data voltages being data voltages that are overdriven by respective overdriving voltages, the first portion of the subpixels corresponding to one or more of the c number of colors, and wherein the c number of colors includes a first color and a second color that are different from each other, a first thickness of a pigment layer in a first subpixel corresponding to the first color is smaller than a second thickness of a pigment layer in a second subpixel corresponding to the second color, and a first overdriving voltage of the data voltage supplied to the first subpixel corresponding to the first color is larger than a second overdriving voltage of the data voltage supplied to the second subpixel corresponding to the second color.

2. The display device according to claim 1, wherein the data driver circuit supplies the data voltages as overdriven data voltages to all of the subpixels of the plurality of subpixels, wherein the data driver circuit supplies subpixels corresponding to at least one of the c number of colors with data voltages overdriven by an overdriving voltage that is different than an overdriving voltage for overdriving subpixels corresponding to at least one other of the c number of colors.

3. The display device according to claim 1, wherein the data driver circuit supplies the data voltages to a second portion of the subpixels as non-overdriven data voltages, the second portion of the subpixels corresponding to a different one of the c number of colors than the first portion of the subpixels.

4. The display device according to claim 1, wherein subpixels corresponding to at least one color among c number of colors have a different response time than subpixels corresponding to at least one other color of the c number of colors.

5. The display device according to claim 4, wherein the data driver circuit supplies data voltages that are overdriven by greater overdriving voltages to subpixels having slower response times, and supplies data voltages that are overdriven by lesser overdriving voltages to subpixels having faster response times.

6. The display device according to claim 1, wherein the overdriven data voltages have waveforms that are higher in voltage level than data voltages for an image to be reproduced in corresponding subpixels among the subpixels corresponding to c number of colors, by the overdriving voltages, during a rising portion of the waveforms.

7. The display device according to claim 1, wherein the controller converts image data corresponding to the one or more of the c number of colors into overdriven image data and provides the overdriven image data to the data driver circuit.

8. The display device according to claim 1, wherein the data driver circuit converts image data corresponding to the c number of colors into overdriven image data having different overdriving levels according to the colors and provides the overdriven image data to the data driver circuit.

9. A display device, comprising:

a display panel on which m number of data lines, where m is a natural number equal to or greater than 2, and n number of gate lines, where n is a natural number equal to or greater than 2, are disposed and a plurality of subpixels are formed;

a data driver circuit supplying data voltages to the plurality of subpixels through the m number of data lines; and a controller providing image data to the data driver circuit and controlling the data driver circuit, wherein the data driver circuit supplies data voltages to the plurality of subpixels that are overdriven differently based on thicknesses of pigment layers in the subpixels, and wherein each of the subpixels corresponds to one of c number of colors, c is a natural number equal to or greater than 2, the c number of colors includes a first color and a second color that are different from each other, a first thickness of a pigment layer in a first subpixel corresponding to the first color is smaller than a second thickness of a pigment layer in a second subpixel corresponding to the second color, and a first overdriving voltage of the data voltage supplied to the first subpixel corresponding to the first color is larger than a second overdriving voltage of the data voltage supplied to the second subpixel corresponding to the second color.

10. A controller comprising:

a color information storage device containing information about colors of a plurality of subpixels disposed on a display panel; and an overdriving controller converting image data for the plurality of subpixels into overdriven image data, in which a rising portion of the image data is overdriven by respective overdriving voltage levels, by referring to the information about the colors of the plurality of subpixels and outputting the overdriven image data, wherein the colors of the plurality of subpixels includes a first color and a second color that are different from each other, a first thickness of a pigment layer in a first subpixel corresponding to the first color is smaller than a second thickness of a pigment layer in a second subpixel corresponding to the second color, and a first overdriving level of the overdriven image data for the first subpixel corresponding to the first color is larger than a second overdriving level of the overdriven image data for the second subpixel corresponding to the second color.

11. The controller according to claim 10, wherein color-specific overdriving levels are referred to when the image data are converted into the overdriven image data, wherein an overdriving level for a specific color among the color-specific overdriving levels is 0.

12. A method of driving a display device, comprising:

receiving image data for a plurality of subpixels disposed on a display panel;

converting the image data for the plurality of subpixels into overdriven image data, based on information about colors of the plurality of subpixels and color-specific overdriving levels; and outputting the overdriven image data, wherein the colors of the plurality of subpixels includes a first color and a second color that are different from each other, a first thickness of a pigment layer in a first subpixel corresponding to the first color is smaller than a second thickness of a pigment layer in a second subpixel corresponding to the second color, and a first overdriving voltage of a data voltage supplied to the first subpixel corresponding to the first color is larger than a second overdrive voltage of a data voltage supplied to the second subpixel corresponding to the second color.

13. The method according to claim 12, wherein an overdriving level for a specific color among the color-specific overdriving levels is 0.

14. A data driver circuit comprising:

an image data input section receiving image data;

a digital-to-analog converter converting the image data into data voltages corresponding to analog voltages; and an output buffer outputting the data voltages to data lines, wherein the data voltages are overdriven by overdriving voltages and are output to data lines connected to subpixels corresponding to one or more colors among subpixels corresponding to c number of colors, the subpixels being disposed on a display panel, where c is a natural number equal to or greater than 2, wherein the c number of colors includes a first color and a second color that are different from each other, a first thickness of a pigment layer in a first subpixel corresponding to the first color is smaller than a second thickness of a pigment layer in a second subpixel corresponding to the second color, and a first overdriving voltage of a data voltage supplied to the first subpixel corresponding to the first color is larger than a second overdrive voltage of a data voltage supplied to the second subpixel corresponding to the second color.

* * * * *